US012435724B2

(12) United States Patent
Higashida et al.

(10) Patent No.: US 12,435,724 B2
(45) Date of Patent: Oct. 7, 2025

(54) CENTRIFUGAL BLOWER

(71) Applicant: DAIKIN INDUSTRIES, LTD, Osaka (JP)

(72) Inventors: Masahito Higashida, Osaka (JP); Toru Iwata, Osaka (JP); Anan Takada, Osaka (JP)

(73) Assignee: DAIKIN INDUSTRIES, LTD, Osaka (JP)

( * ) Notice: Subject to any disclaimer, the term of this patent is extended or adjusted under 35 U.S.C. 154(b) by 0 days.

(21) Appl. No.: 18/848,120

(22) PCT Filed: Mar. 20, 2023

(86) PCT No.: PCT/JP2023/010921
§ 371 (c)(1),
(2) Date: Sep. 17, 2024

(87) PCT Pub. No.: WO2023/182280
PCT Pub. Date: Sep. 28, 2023

(65) Prior Publication Data

US 2025/0198416 A1 Jun. 19, 2025

(30) Foreign Application Priority Data

Mar. 23, 2022 (JP) ..... 2022-046946

(51) Int. Cl.
*F04D 29/42* (2006.01)
*F04D 17/16* (2006.01)
*F04D 29/66* (2006.01)

(52) U.S. Cl.
CPC ..... *F04D 17/16* (2013.01); *F04D 29/4226* (2013.01); *F04D 29/663* (2013.01)

(58) Field of Classification Search
CPC .... F04D 17/16; F04D 29/4226; F04D 29/663; F04D 29/667
See application file for complete search history.

(56) References Cited

U.S. PATENT DOCUMENTS 11,274,678 B2 * 3/2022 Teramoto ..... F04D 29/4226

FOREIGN PATENT DOCUMENTS

CN 110030210 A 7/2019
GB 2551281 A 12/2017
(Continued)

OTHER PUBLICATIONS

International Search Report of corresponding PCT Application No. PCT/JP2023/010921 dated May 30, 2023.
(Continued)

*Primary Examiner* — Sabbir Hasan
(74) *Attorney, Agent, or Firm* — GLOBAL IP COUNSELORS, LLP

(57) ABSTRACT

A centrifugal blower includes an impeller, and a scroll casing. The impeller draws in gas through an opening in a side surface and sends out the gas in a centrifugal direction. The scroll casing includes an inlet, an outlet, a peripheral wall arranged along an impeller outer circumference, and a tongue that guides the gas flowing along the peripheral wall to the outlet. The peripheral wall includes a first planar portion extending continuously from the tongue, and a second planar portion located at a position advanced from the first planar portion in a rotation direction of the impeller. The peripheral wall is arranged so that a clearance is minimal at the second planar portion. The clearance is a difference between distances from a center of the impeller to an inner surface of the peripheral wall and to an outer surface of the impeller in a passage along the peripheral wall.

6 Claims, 3 Drawing Sheets

(56) References Cited

FOREIGN PATENT DOCUMENTS

| | | | | | |
|---|---|---|---|---|---|
| JP | 60-132098 | A | | 7/1985 | |
| JP | 2000-240594 | A | | 9/2000 | |
| JP | 2003-35298 | A | | 2/2003 | |
| JP | 2003035298 | A | * | 2/2003 | |
| WO | WO-2016139732 | A1 | * | 9/2016 | ..... F04D 29/44 |
| WO | 2019/146015 | A1 | | 8/2019 | |

OTHER PUBLICATIONS

International Preliminary Report of corresponding PCT Application No. PCT/JP2023/010921 dated Oct. 3, 2024.
European Search Report of corresponding EP Application No. 23 77 4875.1 dated Jun. 10, 2025.

* cited by examiner

CENTRIFUGAL BLOWER

CROSS-REFERENCE TO RELATED APPLICATIONS

This application is the national phase under 35 U. S. C. § 371 of PCT International Application No. PCT/JP2023/010921 which has an International filing date of Mar. 20, 2023 and designated the United States of America. This U.S. National stage application claims priority under 35 U.S.C. § 119 (a) to Japanese Patent Application No. 2022-046946, filed in Japan on Mar. 23, 2022, the entire contents of which are hereby incorporated herein by reference.

BACKGROUND

Field of the Invention

The present disclosure relates to a centrifugal blower.

Background Information

A typical centrifugal blower (hereinafter referred to as conventional centrifugal blower) is arranged in, for example, an exhaust passage and an air supply passage. Clogging of a filter arranged in the exhaust passage or the air supply passage increases the load applied to the conventional centrifugal blower and causes the centrifugal blower to surge.

SUMMARY

International Patent Publication No. WO2019/146015 describes a centrifugal blower having high static pressure characteristics in a low gas flow rate region. The centrifugal blower described in Patent Literature 1 has a constricted portion (closest portion in International Patent Publication No. WO2019/146015) where a passage is narrowed in a scroll casing. Noise may be generated at the constricted portion.

A technique related to noise suppression in a centrifugal blower is known (for example, Japanese Laid-Open Patent Publication No. 2003-35298). However, this technique is for a conventional centrifugal blower. Thus, it is uncertain whether this technique is effective for reducing surges in a centrifugal blower having high static pressure characteristics in a low gas flow rate region. In this manner, there is room for improvement in the suppression of noise and the reduction of surges in the centrifugal blower having high static pressure characteristics in a low gas flow rate region.

A centrifugal blower that solves the above problem includes an impeller, and a scroll casing accommodating the impeller. The impeller is configured to draw in gas through an opening in a side surface and send out the gas in a centrifugal direction. The scroll casing includes an inlet that draws in the gas, an outlet that blows out the gas sent out from the impeller, a peripheral wall arranged along an outer circumference of the impeller, and a tongue that guides the gas flowing along the peripheral wall to the outlet. The peripheral wall of the scroll casing includes a first planar portion extending continuously from the tongue, and a second planar portion located at a position advanced from the first planar portion in a rotation direction of the impeller. The peripheral wall is configured so that a clearance, that is a difference between a distance from a center of the impeller to an inner surface of the peripheral wall and a distance from the center of the impeller to an outer surface of the impeller in a passage along the peripheral wall, is minimal at the second planar portion.

In the above-described centrifugal blower, the peripheral wall of the scroll casing includes the narrowest portion of the clearance in the passage at a position advanced from the tongue in the rotation direction of the impeller. Thus, the clearance in the proximity of the tongue is greater than the clearance in the proximity of the narrowest portion. This limits turbulence in the proximity of the tongue and reduces the generation of surges. The flow of gas in the passage may stagnate from the tongue to the narrowest portion. The gas flow stagnation will generate noise. In this respect, with the above-described structure, the first planar portion is arranged at the tongue, and the second planar portion is arranged at the narrowest portion. This rectifies the flow of gas in the range from the tongue to the narrowest portion and alleviates the stagnation of the flow of gas. Thus, surges are reduced and the generation of noise is suppressed.

In the above-described centrifugal blower, with respect to the clearance, when a first clearance is defined as a value obtained by subtracting a radius of the impeller from a length of a first perpendicular line extending from a center of the impeller to the first planar portion, and when a second clearance is defined as a value obtained by subtracting the radius of the impeller from a length of a second perpendicular line extending from the center of the impeller to the second planar portion, a ratio of the first clearance to the second clearance is in a range from 1.5 to 2.5, inclusive.

When the ratio of the first clearance to the second clearance is greater than 2.5, the passage will be narrowed excessively from the tongue to the narrowest portion. Thus, the flow of gas is apt to stagnate, thereby generating noise in the proximity of the narrowest portion. When the ratio of the first clearance to the second clearance is less than 1.5, the passage will be narrowed to a small degree from the tongue to the narrowest portion. In this case, the size of the clearance in the proximity of the tongue, which is the entrance of the passage, will be close to the size of the clearance at the narrowest portion. Thus, the passage will be narrow from the tongue to the narrowest portion, thereby hindering the flow of gas. As a result, turbulence will be apt to be generated in the proximity of the tongue. This will lower the surge reducing effect.

In this respect, the above-described structure reduces turbulence in the proximity of the tongue and alleviates gas flow stagnation in the proximity of the narrowest portion. This effectively reduces surges and suppresses the generation of noise.

In the above-described centrifugal blower, an angle from the first perpendicular line to the second perpendicular line in a rotation direction of the impeller is in a range from 80 degrees to 110 degrees, inclusive. With this structure, the centrifugal blower has higher static pressure characteristics than when the angle is less than 80 degrees or greater than 110 degrees.

In the above-described centrifugal blower, an angle from the first perpendicular line to the second perpendicular line in a rotation direction of the impeller is in a range from 20 degrees to 40 degrees, inclusive. In this structure, the centrifugal blower has a higher static pressure efficiency than when the angle is less than 20 degrees or greater than 40 degrees.

In the above-described centrifugal blower, a quantity of blades of the impeller is 60 or greater. In the case of the conventional centrifugal blower, an increase in the quantity of the blades will have a poor effect on increasing the static pressure in a low gas flow rate region (high load region). In contrast, in the case of the centrifugal blower of the present disclosure, an increase in the quantity of the blades has an effect on increasing the static pressure in the low gas flow rate region regarding the gas flow rate-static pressure characteristics. Thus, the centrifugal blower having the above-described structure has a higher static pressure in the low gas flow rate region than a centrifugal blower having 40 blades.

DETAILED DESCRIPTION OF EMBODIMENT(S)

A centrifugal blower 1 will now be described with reference to FIGS. 1 to 5. The centrifugal blower 1 includes a sirocco fan, a limit load fan, and a turbo fan. In the present embodiment, the centrifugal blower 1 is, for example, a sirocco fan. The centrifugal blower 1 is arranged in an air conditioner or a blower. In the present embodiment, the gas is air. The gas includes air, argon gas, oxygen gas, and nitrogen gas. In the present embodiment, a view of the centrifugal blower 1 in a direction extending along the center axis C of the shaft 11 is referred to as side view.

Structure of Centrifugal Blower

Figure 1:
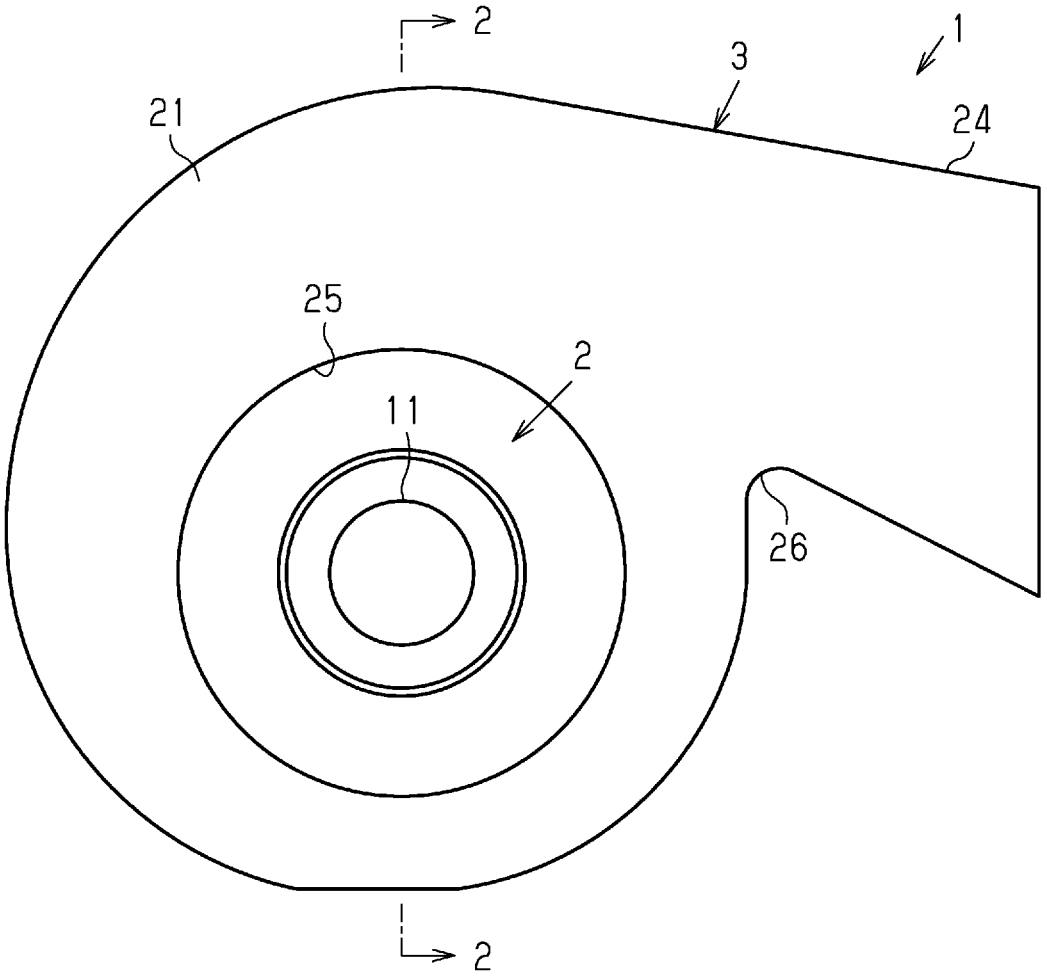
FIG. 1 is a side view of a centrifugal blower according to a present embodiment.

As shown in FIG. 1, the centrifugal blower 1 includes an impeller 2 and a scroll casing 3 that accommodates the impeller 2.

Structure of Impeller

The impeller 2 is configured to draw in gas through an opening 15 in a side surface and send out the gas in a centrifugal direction.

Figure 2:
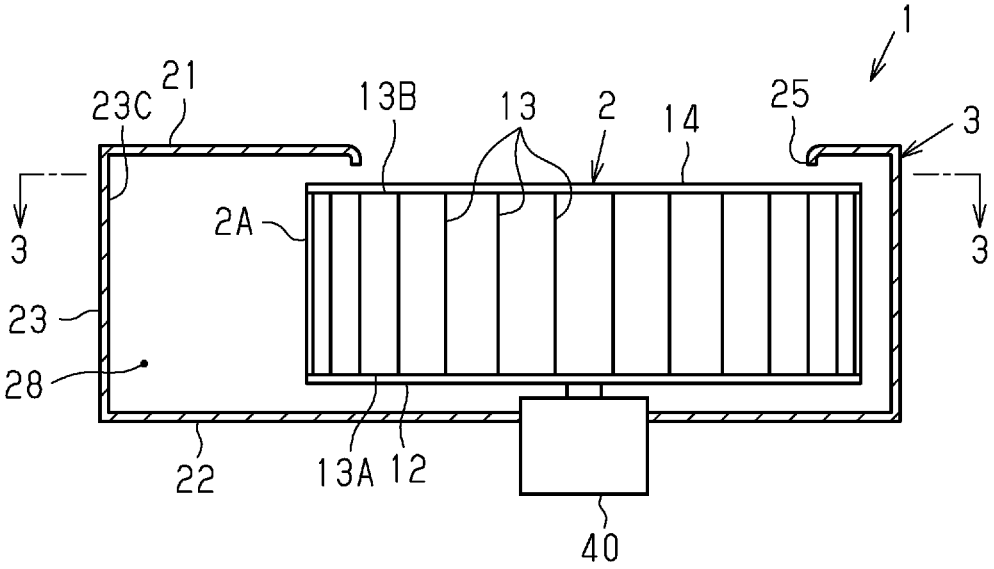
FIG. 2 is a cross-sectional view of the centrifugal blower taken along line 2-2 in FIG. 1.

As shown in FIGS. 1 and 2, the impeller 2 includes a shaft 11, a base 12 fixed to the shaft 11, blades 13 arranged on the base 12, and a ring 14 coupling the blades 13. The shaft 11 is fixed to an output shaft of a motor 40. The base 12 is formed by a disk of which the center is the center axis C of the shaft 11. The blades 13 are arranged at predetermined intervals along the outer circumference of the base 12. The blades 13 are arranged so that the longitudinal direction of each blade 13 is parallel to the shaft 11. The blades 13 each include a first end 13A that is connected to the base 12, and a second end 13B that is opposite to the first end 13A and connected to the ring 14. The impeller 2 includes the opening 15 (refer to FIG. 3). The opening 15 is arranged within the ring 14. In other words, the opening 15 is defined by the inner circumference of the ring 14. The opening 15 overlaps an inlet 25 of the scroll casing 3 in a state in which the impeller 2 is accommodated in the scroll casing 3 in side view. The opening 15 is open toward the space outside the scroll casing 3.

The quantity of the blades 13 of the impeller 2 is 40 or greater. In one example, the quantity of the blades 13 of the impeller 2 is 60 or greater. The quantity of the blades 13 of the impeller 2 is preferably a prime number. For example, the quantity of the blades 13 of the impeller 2 is 41, 51, or 61.

In the present embodiment, the radius R of the impeller 2 is defined as the distance between the center axis C of the shaft 11 and the outer ends of the blades 13 in the radial direction. In the present embodiment, an upstream side of the centrifugal blower 1 refers to a portion in a passage 28 in the proximity of a tongue 26. A downstream side of the centrifugal blower 1 refers to a portion in the passage 28 in the proximity of an outlet 24.

Scroll Casing

Figure 3:
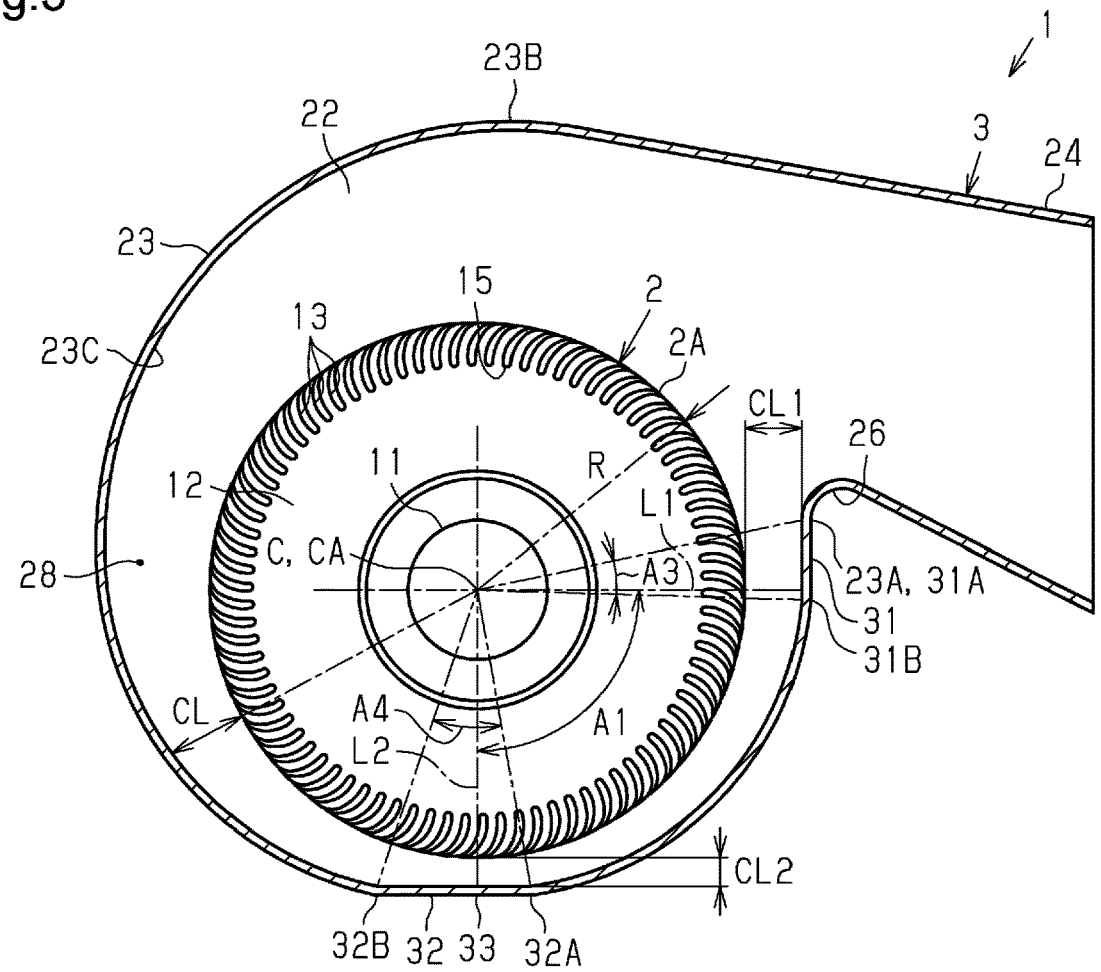
FIG. 3 is a cross-sectional view of the centrifugal blower taken along line 3-3 in FIG. 2.

As shown in FIG. 3, the scroll casing 3 accommodates the impeller 2. The scroll casing 3 includes a first side wall 21, a second side wall 22 similar in shape to the first side wall 21, and a peripheral wall 23. The scroll casing 3 further includes the outlet 24, the inlet 25, and the tongue 26.

The first side wall 21 and the second side wall 22 form the side surfaces of the scroll casing 3. The peripheral wall 23 is arranged along the outer circumference of the impeller 2. Specifically, the peripheral wall 23 is arranged between the first side wall 21 and the second side wall 22. The peripheral wall 23 is arranged along the edge of the first side wall 21 and the edge of the second side wall 22. The peripheral wall 23 connects the first side wall 21 and the second side wall 22. The peripheral wall 23 extends in a spiral manner about the center axis C of the shaft 11.

The peripheral wall 23 forms the passage 28 of gas between the peripheral wall 23 and the impeller 2. A passage cross-sectional area refers to the area of a cross-section when the passage 28 is cut along a plane including the center axis C of the shaft 11. The passage cross-sectional area gradually decreases from a downstream end 31B of a first planar portion 31 to an upstream end 32A of a second planar portion 32. The passage cross-sectional area gradually increases from a downstream end 32B of the second planar portion 32 toward the outlet 24.

Gas is drawn in through the inlet 25. The inlet 25 is formed in the first side wall 21 or the second side wall 22. In the present embodiment, the inlet 25 is formed in the first side wall 21. The inlet 25 is formed by a bell mouth. The inlet 25 is circular. The inlet 25 has substantially the same size as the opening 15 of the impeller 2. The center of the inlet 25 is located at the same position as the center axis C of the shaft 11.

The outlet 24 is the part where gas is blown out of the impeller 2. The outlet 24 is tubular. The outlet 24 is arranged at a downstream end 23B of the peripheral wall 23. The tongue 26 guides the gas flowing along the peripheral wall 23 to the outlet 24. The tongue 26 is continuous with an upstream end 23A of the peripheral wall 23. The upstream end 23A of the peripheral wall 23 is the same part as an upstream end 31A of the first planar portion 31.

The peripheral wall 23 includes the first planar portion 31 and the second planar portion 32. The first planar portion 31 extends continuously from the tongue 26. The first planar portion 31 is orthogonal to a straight line extending from the center CA of the impeller 2. The second planar portion 32 is located at a position advanced from the first planar portion 31 in the rotation direction of the impeller 2. The second planar portion 32 is orthogonal to a straight line extending from the center CA of the impeller 2.

The peripheral wall 23 is configured so that a clearance CL in the passage 28 is minimal at the second planar portion 32. The clearance CL is defined as the difference between the distance from the center CA of the impeller 2 to an inner surface 23C of the peripheral wall 23 and the distance from the center CA of the impeller 2 to the outer surface 2A of the impeller 2. The outer surface 2A of the impeller 2 is a surface formed by connecting the outer ends of the blades 13. The clearance CL is substantially equal to a value obtained by subtracting the radius R of the impeller 2 from the distance from the center CA of the impeller 2 to the inner surface 23C of the peripheral wall 23 on a line extending in the radial direction.

In one example, a narrowest portion 33 where the clearance CL at the second planar portion 32 is minimal is located between the upstream end 32A and the downstream end 32B of the second planar portion 32. The distance between the narrowest portion 33 and the downstream end 32B of the second planar portion 32 is greater than the distance between the narrowest portion 33 and the upstream end 32A of the second planar portion 32. The narrowest portion 33 in the second planar portion 32 may be the upstream end 32A of the second planar portion 32. The narrowest portion 33 in the second planar portion 32 may be the downstream end 32B of the second planar portion 32.

In one example, an angle A3 between a line connecting the center CA of the impeller 2 and the upstream end 31A of the first planar portion 31 and a line connecting the center CA of the impeller 2 and the downstream end 31B of the first planar portion 31 is in a range from 5 degrees to 20 degrees, inclusive. In one example, an angle A4 between a line connecting the center CA of the impeller 2 and the upstream end 32A of the second planar portion 32 and a line connecting the center CA of the impeller 2 and the downstream end 32B of the second planar portion 32 is in a range from 5 degrees to 30 degrees, inclusive.

A line extending from the center of the impeller 2 to the first planar portion 31 in side view is defined as a first perpendicular line L1. A line extending from the center of the impeller 2 to the second planar portion 32 in side view is defined as a second perpendicular line L2.

The ratio of a first clearance CL1 to a second clearance CL2 is preferably in a range from 1.5 to 2.5, inclusive. The first clearance CL1 is defined as a value obtained by subtracting the radius R of the impeller 2 from the length of the first perpendicular line L1. The second clearance CL2 is defined as a value obtained by subtracting the radius R of the impeller 2 from the length of the second perpendicular line L2.

The first perpendicular line L1 extends proximate to the tongue 26. The second perpendicular line L2 has the following relationship with the first perpendicular line L1. An angle A1 from the first perpendicular line L1 to the second perpendicular line L2 in the rotation direction of the impeller 2 is in a range from 80 degrees to 110 degrees, inclusive.

Characteristics of Centrifugal Blower

The characteristics of the centrifugal blower 1 of the present embodiment will now be described with reference to FIGS. 4 and 5.

Figure 4:
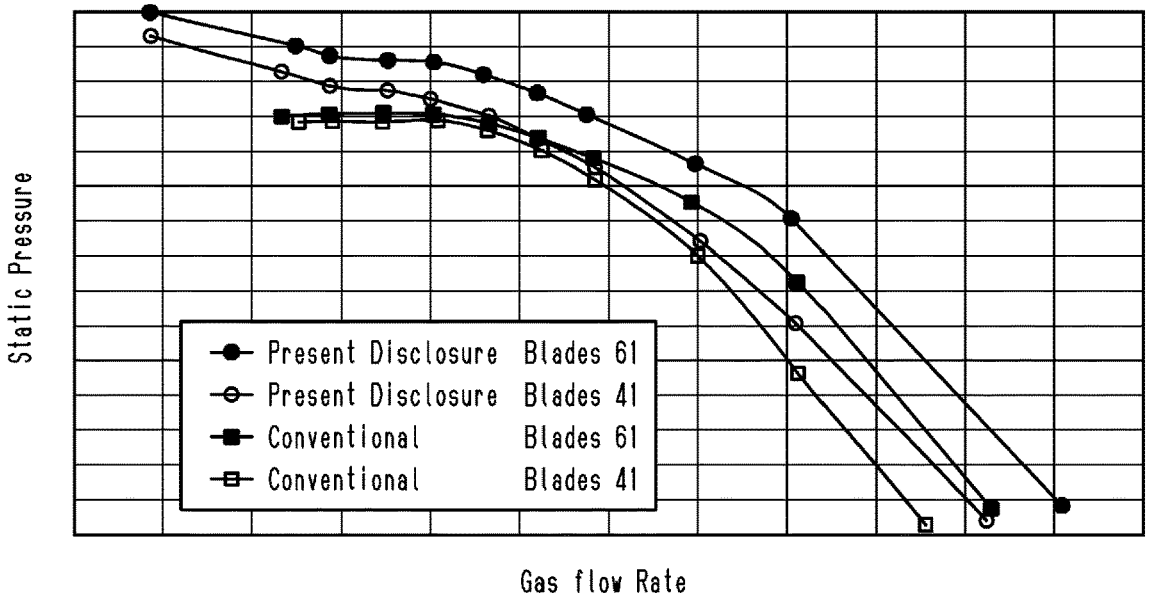
FIG. 4 is a graph showing the gas flow rate-static pressure characteristics of the centrifugal blowers in the present embodiment and a referential example.

FIG. 4 shows the static pressure-gas flow rate characteristics of the centrifugal blower 1. In FIG. 4, the line plotting black dots indicates the characteristics of the centrifugal blower 1 of the present embodiment that has 61 blades 13. In FIG. 4, the line plotting white dots indicates the characteristics of the centrifugal blower 1 of the present embodiment that has 41 blades 13. In FIG. 4, the line plotting black squares indicates the characteristics of a centrifugal blower of a referential example having 61 blades 13. In FIG. 4, the line plotting white squares indicates the characteristics of the centrifugal blower of the referential example that has 41 blades 13. The centrifugal blower of the referential example differs from the centrifugal blower 1 of the present embodiment in the following points. The centrifugal blower of the referential example includes the first planar portion 31 but not the second planar portion 32. Except in that there is no second planar portion 32, the centrifugal blower of the referential example has the same structure as the centrifugal blower 1 of the present embodiment.

As shown in FIG. 4, the centrifugal blower 1 of the present embodiment has a higher static pressure in a low gas flow rate region than the centrifugal blower of the referential example. Thus, even when dust collects on a filter in a duct where the centrifugal blower 1 is installed and increases the load on the centrifugal blower 1, surges will be limited, and noise generated by surges will be suppressed. Further, the centrifugal blower 1 of the present embodiment can be applied in a preferred manner to a discharge portion of a device including a high efficiency particulate air filter (HEPA filter).

As shown in FIG. 4, in the centrifugal blower of the referential example, even when the quantity of the blades 13 is increased, the static pressure is not increased in the low gas flow rate region. In contrast, in the centrifugal blower 1 of the present embodiment, when the quantity of the blades 13 is increased, the static pressure is increased in the low gas flow rate region. Thus, in the centrifugal blower 1 of the present embodiment, the static pressure characteristics in the low gas flow rate region can be adjusted by the quantity of the blades 13 that is set.

Figure 5:
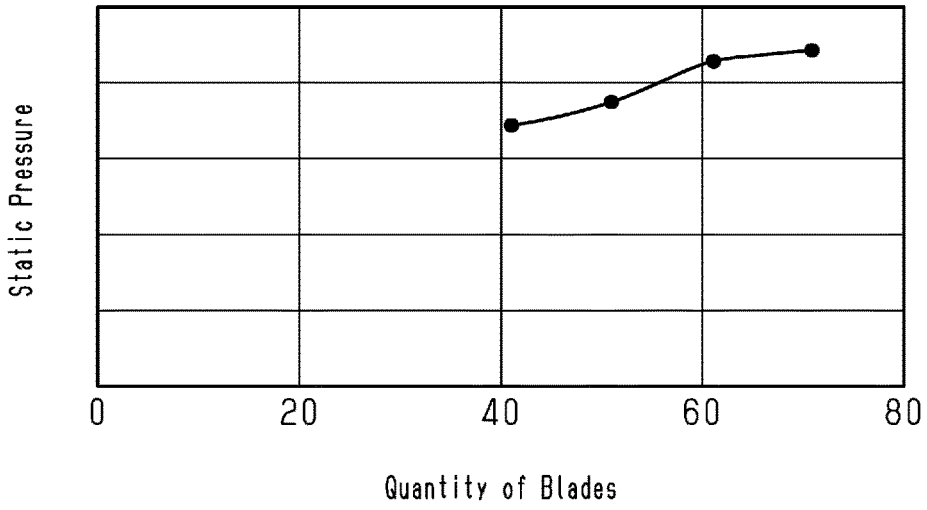
FIG. 5 is a graph showing the quantity of blades and static pressure characteristics of the centrifugal blower in the present embodiment.

FIG. 5 shows the static pressure of centrifugal blowers 1 having different quantities of the blades 13 in the present embodiment when the gas flow rate is 2 $m^3$/min. The horizontal axis represents the quantity of the blades 13. The vertical axis represents the static pressure. As shown in FIG. 5, in the centrifugal blower 1 of the present embodiment, the static pressure in the low gas flow rate region increases as the quantity of the blades 13 increases.

Operation

The operation of the present embodiment will now be described.

In the proximity of the outlet 24 of the scroll casing 3, the gas blown out of the impeller 2 is apt to directly strike the tongue 26. This will cause turbulence in the proximity of the tongue 26. In the present embodiment, the first planar portion 31 is arranged continuously with the tongue 26. In the passage 28, the clearance CL at the first planar portion 31 is greater than the clearance CL at the second planar portion 32. The tongue 26 is located farther from the impeller 2 than the conventional centrifugal blower. This reduces turbulence in the proximity of the tongue 26.

In the path from the first planar portion 31 to the second planar portion 32, the passage cross-sectional area is gradually decreased. Thus, the gas blown out of the impeller 2 into the path from the first planar portion 31 to the second planar portion 32 will stagnate at the narrowest portion 33 of the passage 28 and causes turbulence. When gas does not flow smoothly from the inlet 25 to the outlet 24, noise is generated in the proximity of the narrowest portion 33. In this respect, in the present embodiment, the second planar portion 32 is arranged in the narrowest portion 33 of the passage 28. This alleviates the stagnation of the flow of gas. Further, the first planar portion 31 allows gas to flow smoothly in the path from the first planar portion 31 to the second planar portion 32. As a result, the flow of gas is rectified in a range from the tongue 26 to the narrowest portion 33, thereby alleviating gas flow stagnation. This reduces surges and suppresses the generation of noise.

Advantages

The advantages of the present embodiment will now be described.

(1) In the centrifugal blower 1, the peripheral wall 23 of the scroll casing 3 includes the first planar portion 31 and the second planar portion 32. The first planar portion 31 extends continuously from the tongue 26. The second planar portion 32 is located at a position advanced from the first planar portion 31 in the rotation direction of the impeller 2. The peripheral wall 23 is configured so that the clearance CL in the passage 28 is minimal at the second planar portion 32. The clearance CL is the difference between the distance from the center CA of the impeller 2 to the inner surface 23C of the peripheral wall 23 and the distance from the center CA of the impeller 2 to the outer surface 2A of the impeller 2.

In this structure, the peripheral wall 23 of the scroll casing 3 includes the narrowest portion 33 of the clearance CL in the passage 28 at a position advanced from the tongue 26 in the rotation direction of the impeller 2. Thus, the clearance CL in the proximity of the tongue 26 is greater than the clearance CL in the proximity of the narrowest portion 33. This limits turbulence in the proximity of the tongue 26 and reduces the generation of surges. The flow of gas in the passage 28 may stagnate from the tongue 26 to the narrowest portion 33. The gas flow stagnation will generate noise. In this respect, with the above-described structure, the first planar portion 31 is arranged at the tongue 26, and the second planar portion 32 is arranged at the narrowest portion 33. This rectifies the flow of gas in the range from the tongue 26 to the narrowest portion 33 and alleviates the stagnation of the flow of gas. Thus, surges are reduced and the generation of noise is suppressed.

(2) In the centrifugal blower 1, the ratio of the first clearance CL1 to the second clearance CL2 is in the range from 1.5 to 2.5, inclusive. When the ratio of the first clearance CL1 to the second clearance CL2 is greater than 2.5, the passage 28 will be narrowed excessively from the tongue 26 to the narrowest portion 33. Thus, the flow of gas is apt to stagnate, thereby generating noise in the proximity of the narrowest portion 33. When the ratio of the first clearance CL1 to the second clearance CL2 is less than 1.5, the passage 28 will be narrowed to a small degree from the tongue 26 to the narrowest portion 33. In this case, the size of the clearance CL in the proximity of the tongue 26, which is the entrance of the passage 28, will be close to the size of the clearance CL at the narrowest portion 33. Thus, the passage 28 will be narrow from the tongue 26 to the narrowest portion 33, thereby hindering the flow of gas. As a result, turbulence will be apt to be generated in the proximity of the tongue 26. This will lower the surge-reducing effect. In this respect, the above-described structure reduces turbulence in the proximity of the tongue 26 and alleviates gas flow stagnation in the proximity of the narrowest portion 33. This effectively reduces surges and suppresses the generation of noise.

(3) In the centrifugal blower 1, the angle A1 from the first perpendicular line L1 to the second perpendicular line L2 in the rotation direction of the impeller 2 is in the range from 80 degrees to 110 degrees, inclusive. With this structure, the centrifugal blower 1 has higher static pressure characteristics than when the angle A1 is less than 80 degrees or greater than 110 degrees.

(4) In the centrifugal blower 1, the quantity of the blades 13 of the impeller 2 is 60 or greater. In the case of the conventional centrifugal blower, an increase in the quantity of the blades 13 will have a poor effect on increasing the static pressure in a low gas flow rate region (high load region). The conventional centrifugal blower neither includes the first planar portion 31 nor the second planar portion 32, and the cross-sectional passage area gradually increases from the tongue 26. In the conventional centrifugal blower, the effect that an increase in the quantity of the blades 13 has on increasing the static pressure is the same as that in the referential examples shown in FIG. 4. However, the effect that an increase in the quantity of the blades 13 has on increasing the static pressure is poor.

In contrast, in the case of the centrifugal blower 1 of the present disclosure, an increase in the quantity of the blades 13 has an effect on increasing the static pressure in the low gas flow rate region regarding the gas flow rate-static pressure characteristics. Thus, the centrifugal blower 1 having the above-described structure has a higher static pressure in the low gas flow rate region than the centrifugal blower 1 having 40 blades 13.

Modified Examples

In addition to the above embodiment, the centrifugal blower 1 of the present disclosure may be, for example, modified as illustrated in the examples described below or be implemented by combining at least two of the modified examples as long as they do not contradict each other.

Figure 6:
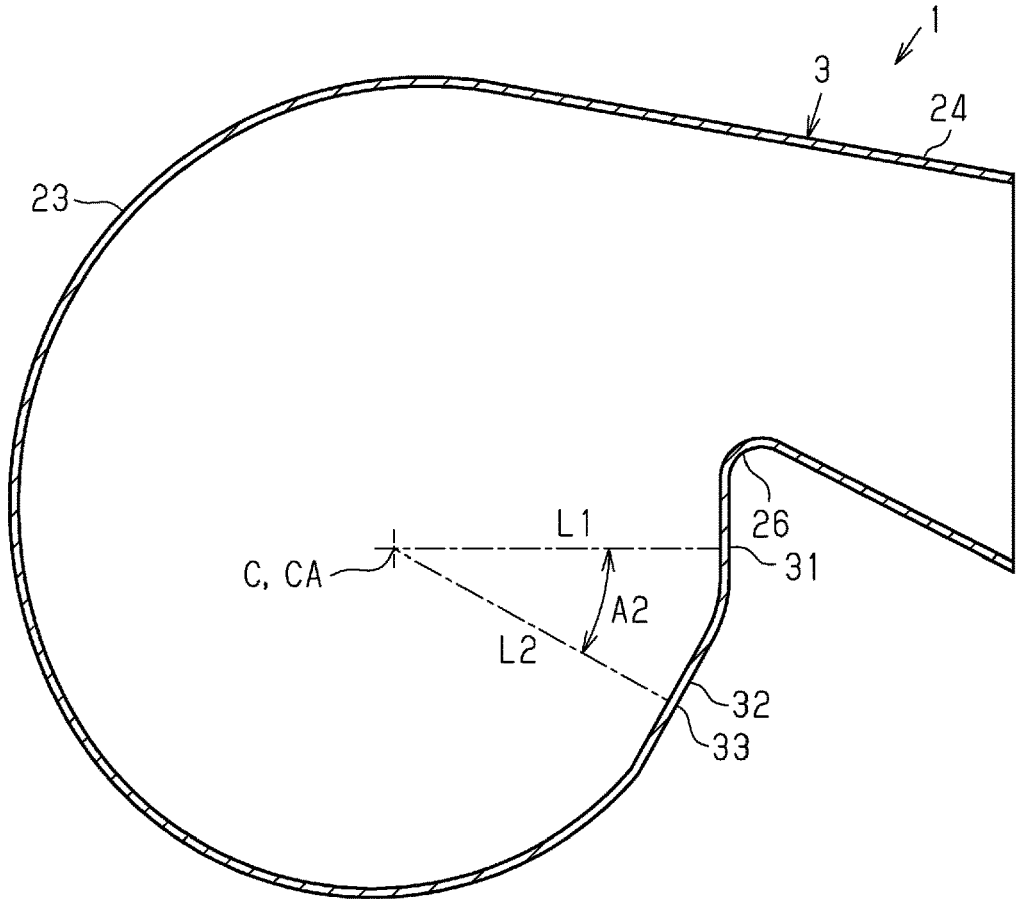
FIG. 6 is a schematic cross-sectional view of a scroll casing in a modified example of the centrifugal blower.

The centrifugal blower 1 of a modified example will now be described with reference to FIG. 6. In this embodiment, the angle A1 from the first perpendicular line L1 to the second perpendicular line L2 in the rotation direction of the impeller 2 is in the range from 80 degrees to 110 degrees, inclusive. In contrast, as shown in FIG. 6, an angle A2 from the first perpendicular line L1 to the second perpendicular line L2 in the rotation direction of the impeller 2 may be set in a range from 20 degrees to 40 degrees, inclusive. In this structure, the centrifugal blower 1 has a higher static pressure efficiency than when the angle A2 is less than 20 degrees or greater than 40 degrees. The static pressure efficiency is expressed as gas flow rate×static pressure/(60× shaft power).

Although the centrifugal blower 1 according to the embodiment has been described above, it will be understood that various changes in modes and details can be made without departing from the spirit and scope of the centrifugal blower 1 in the claims.

The invention claimed is:

1. A centrifugal blower, comprising:

an impeller; and a scroll casing accommodating the impeller, the impeller being configured to draw in gas through an opening in a side surface and send out the gas in a centrifugal direction thereof, the scroll casing including an inlet that draws in the gas, an outlet that blows out the gas sent out from the impeller, a peripheral wall arranged along an outer circumference of the impeller, and a tongue that guides the gas flowing along the peripheral wall to the outlet, the peripheral wall of the scroll casing including a first planar portion extending continuously from the tongue, and a second planar portion located at a position advanced from the first planar portion in a rotation direction of the impeller, the peripheral wall being configured so that a clearance is minimal at the second planar portion, the clearance being a difference between a distance from a center of the impeller to an inner surface of the peripheral wall, and a distance from the center of the impeller to an outer surface of the impeller in a passage along the peripheral wall, and with respect to the clearance when a first clearance is defined as a value obtained by subtracting a radius of the impeller from a length of a first perpendicular line extending from the center of the impeller to the first planar portion, and when a second clearance is defined as a value obtained by subtracting the radius of the impeller from a length of a second perpendicular line extending from the center of the impeller to the second planar portion, a ratio of the first clearance to the second clearance being in a range from 1.5 to 2.5, inclusive.

2. The centrifugal blower according to claim 1, wherein an angle from the first perpendicular line to the second perpendicular line in a rotation direction of the impeller is in a range from 80 degrees to 110 degrees, inclusive.

3. The centrifugal blower according to claim 2, wherein a quantity of blades of the impeller is 60 or greater.

4. The centrifugal blower according to claim 1, wherein an angle from the first perpendicular line to the second perpendicular line in a rotation direction of the impeller is in a range from 20 degrees to 40 degrees, inclusive.

5. The centrifugal blower according to claim 4, wherein a quantity of blades of the impeller is 60 or greater.

6. The centrifugal blower according to claim 1, wherein a quantity of blades of the impeller is 60 or greater.

* * * * *